US010584524B2

(12) United States Patent
Fang et al.

(10) Patent No.: US 10,584,524 B2
(45) Date of Patent: Mar. 10, 2020

(54) DOMESTIC REFRIGERATOR HAVING A CLOSING CAM WHICH HAS A COUPLING PROJECTION WITH A RECESS

(71) Applicant: BSH HAUSGAERETE GMBH, Munich (DE)

(72) Inventors: Shizeng Fang, Giengen (DE); Klaus Flinner, Zoeschingen (DE); Alexander Goerz, Aalen (DE); Alfred Raab, Huettlingen (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/328,101

(22) PCT Filed: Jul. 24, 2015

(86) PCT No.: PCT/EP2015/066961
§ 371 (c)(1),
(2) Date: Jan. 23, 2017

(87) PCT Pub. No.: WO2016/012577
PCT Pub. Date: Jan. 28, 2016

(65) Prior Publication Data
US 2017/0211304 A1 Jul. 27, 2017

(30) Foreign Application Priority Data
Jul. 25, 2014 (DE) ..... 10 2014 214 635

(51) Int. Cl.
*E05D 11/00* (2006.01)
*E05D 11/10* (2006.01)
(Continued)

(52) U.S. Cl.
CPC ..... *E05D 11/1014* (2013.01); *E05D 7/081* (2013.01); *F25D 23/028* (2013.01);
(Continued)

(58) Field of Classification Search
CPC ..... F25D 2323/024; F25D 2323/023; F25D 2323/028; F25D 2323/02; F25D 2323/04;
(Continued)

(56) References Cited

U.S. PATENT DOCUMENTS 1,898,161 A * 2/1933 Arnold ..... E05D 7/081 16/361
2,126,579 A * 8/1938 Roethel ..... E05D 11/1014 16/347
(Continued)

FOREIGN PATENT DOCUMENTS

CN 1070978 A 4/1993
CN 102322191 A 1/2012
(Continued)

OTHER PUBLICATIONS translation of KR20070116504; Hong Dae Jin (Year: 2007).*

*Primary Examiner* — Janet M Wilkens
(74) *Attorney, Agent, or Firm* — Laurence A. Greenberg; Werner H. Stemer; Ralph E. Locher

(57) ABSTRACT

A domestic refrigerator has a housing and a door pivotably disposed on the housing by way of hinges. At least one hinge has a door closing fitting part on the door side with a closing clip. A bearing element having a closing cam which is coupled to the locking clip in the closed state of the door is formed on the housing. The closing cam has a coupling projection formed, on a coupling contour which faces it in the state in which it is coupled to the locking clip, with a recess in which a projection end piece formed on the locking clip engages in the coupled state.

6 Claims, 3 Drawing Sheets

(51) Int. Cl.
*F25D 23/02* (2006.01)
*E05D 7/081* (2006.01)

(52) U.S. Cl.
CPC ..... *E05D 11/105* (2013.01); *E05Y 2900/31* (2013.01); *F25D 2323/024* (2013.01)

(58) Field of Classification Search
CPC .. E05D 11/1014; E05D 7/081; E05Y 2900/31
USPC ..... 312/405, 326, 329; 49/386; 292/23, 194, 292/195.1, DIG. 17; 16/49, 50, 71, 78, 16/82, 312–315, 231
See application file for complete search history.

(56) References Cited

U.S. PATENT DOCUMENTS 2,490,494 A * 12/1949 Widman ..... F25D 25/00 312/301
2,807,154 A * 9/1957 Brosenius ..... F25D 23/003 62/259.1
3,996,699 A * 12/1976 Crowe ..... E05F 1/1253 292/74
4,609,234 A * 9/1986 Naniwa ..... E05D 3/022 16/341
4,817,240 A * 4/1989 Sovis, Jr. ..... E05D 11/1014 126/194
5,052,151 A 10/1991 Inui
5,060,344 A * 10/1991 Cress ..... E05D 11/1014 16/332
8,388,077 B2 3/2013 Park
2004/0093799 A1* 5/2004 Yoshikawa ..... E05D 3/022 49/192
2006/0232176 A1* 10/2006 Kim ..... E05D 3/12 312/405
2006/0238091 A1* 10/2006 Linke ..... E05C 19/02 312/405
2008/0203739 A1* 8/2008 Lim ..... E05B 65/0042 292/340
2013/0264930 A1* 10/2013 Kim ..... E05F 1/00 312/404
2014/0145576 A1* 5/2014 White ..... E05F 1/1253 312/319.1
2014/0232250 A1* 8/2014 Kim ..... F25D 23/028 312/292
2014/0232251 A1* 8/2014 Kim ..... F25D 23/028 312/404
2015/0260447 A1* 9/2015 Kim ..... F25D 27/005 312/405

FOREIGN PATENT DOCUMENTS

CN 102900293 A 1/2013
CN 203011050 U 6/2013
CN 103410396 A 11/2013
JP 2007024460 A 2/2007
JP 2011058780 A 3/2011
JP 2015004472 * 1/2015
KR 20040056345 A 6/2004
KR 20070116504 A 12/2007
KR 20080047148 * 5/2008
WO 03018945 A1 3/2003
WO 2009123393 A1 10/2009
WO 2014166850 * 10/2014
WO 2014203993 * 12/2014
WO 2017109648 * 6/2017

* cited by examiner

DOMESTIC REFRIGERATOR HAVING A CLOSING CAM WHICH HAS A COUPLING PROJECTION WITH A RECESS

BACKGROUND OF THE INVENTION

Field of the Invention

The present invention relates to a domestic refrigeration appliance with a housing and a door arranged on the housing in such a manner that it can be pivoted by means of hinges, at least one hinge having a door closing fitting part on the door side with a closing clip. A bearing element with a closing cam, which is coupled to the closing clip when the door is in the closed state, is configured on the housing.

A refrigeration appliance with a door leaf is known from WO 03/018945 A1, said door leaf being supported on the base body of the refrigeration appliance in such a manner that it can be pivoted by means of door hinges in order to open and close the storage chamber of the refrigeration appliance. A closing mechanism is assigned to the door hinge, said closing mechanism having a hook-type configuration. During an operation to close the door leaf, a user first pivots the open door leaf to just before the final closing position. In this position a protrusion on the hook-type elastic closing mechanism comes into contact with a fitting part of the door hinge connected in a fixed manner to the base body. This happens in such a manner that a spring force of the hook-type closing mechanism automatically pushes the door leaf into the final closing position. The door hinge has a fastening block with a continuous receiving slot on an end face of the door leaf. A rectangular fastening segment of the hook-type closing mechanism can be inserted into the receiving slot from one side or an opposite side depending on the hinge side and can be fastened therein by means of a central screw. To form the receiving slot it is necessary for the structural height of the fastening block on the door leaf side to be much larger than the thickness of the closing mechanism. The use of a single screw to fasten the closing mechanism on the end face of the door leaf means that the hook-type closing mechanism can still execute an unwanted rotational movement about the screw to a certain degree.

With known domestic refrigeration appliances independent closing can only take place to a limited degree from a defined angle and therefore from a defined door position. Also with known domestic refrigeration appliances a relatively forceful closing of the door can give rise to the problem that the door springs open again, in particular such that the door does not then close again independently due to the inadequate closing system.

SUMMARY OF THE INVENTION

It is the object of the present invention to create a domestic refrigeration appliance with improved door closing.

This object is achieved by a domestic refrigeration appliance having the features as claimed.

An inventive domestic refrigeration appliance comprises a housing and a door, which is arranged on the housing in such a manner that it can be pivoted by means of hinges. At least one hinge has a door closing fitting part on the door side. A bearing element with a closing cam is configured on the housing, the closing cam being coupled to the closing clip when the door is in the closed state. One important concept of the invention is that the closing cam has a coupling projection, which has a recess on a coupling contour that is facing when coupled to the closing clip, in which recess a projection end piece formed on the closing clip engages in the coupled state. Such an embodiment of the coupling elements means that when the door is closed quite forcefully with the result that the door springs open again to a certain degree, the door closes again independently even after springing open again slightly in this manner due to the new closing system. This quite specific embodiment of the coupling contour with a recess means that the projection end piece can move back into the recess even when it has been moved out of the recess slightly and as a result can bring about such automatic and complete closing. More reliable independent closing is also achieved when the door is only opened slightly at a small angle during a closing movement, as the embodiment of the coupling contour with the recess means that the projection end piece of the closing clip is then better able to slide independently into the recess from this critical angle.

Provision is preferably made for the coupling contour of the recess to be configured without corners. The advantages mentioned above are further favored by this, and jamming and catching are prevented. It is also possible to achieve an embodiment of the coupling apparatus with the projection end piece and recess that is more resistant to wear and remains functional in the long term.

Provision is preferably made for the projection end piece to have a corner-free contour on its side facing the recess. This also further promotes the advantages set out above and a very continuous and therefore smooth mechanical coupling can take place between the projection end piece and the recess over almost the entire coupling path.

Provision is preferably made for the coupling contour to have a concave curvature to configure the recess. This means that an inwardly configured bend or depression is shaped as it were quite specifically so that, when coupled to the recess, the projection end piece also latches therein and is held to a certain degree, thereby preventing independent detachment.

Provision is preferably made for the recess to be configured to hold the projection end piece with a close fit at least in parts. This ensures that the projection end piece sits snugly in the recess in the coupled end state, thereby improving the advantages set out above.

Provision is preferably made for the closing clip to be arranged in a resilient manner on the door closing fitting part. Such individual specific deformation elasticity improves the coupling of the closing clip to the closing cam, allowing easier and smoother mechanical connection here too.

Provision is preferably made for the door closing fitting part to be arranged on a lower narrow face of the door. In addition to improved closing behavior the invention also allows the effect of springing open again when the door is closed quite forcefully to be significantly reduced. The specific shaping of the coupling contour of the closing cams reduces the strain on the closing hook or projection end piece of the closing clip when the door is in the closed state. It also allows the closed door to be held in the closed state more efficiently.

Further features of the invention will emerge from the claims, the figures and the description of the figures. The features and feature combinations set out above in the description and the features and feature combinations set out below in the description of the figures and/or shown in the figures alone can be used not only in the combination specified in each instance but also in other combinations or alone without departing from the scope of the invention. Therefore embodiments of the invention, which are not specifically shown and described in the figures but emerge and can be generated by means of separate feature combinations from the described embodiments, should also be considered to be included and disclosed.

One exemplary embodiment of the invention is described in more detail below with reference to schematic drawings, in which:

BRIEF DESCRIPTION OF THE SEVERAL VIEWS OF THE DRAWING

Identical elements or elements of identical function are shown with identical reference characters in the figures.

DESCRIPTION OF THE INVENTION

Figure 1:
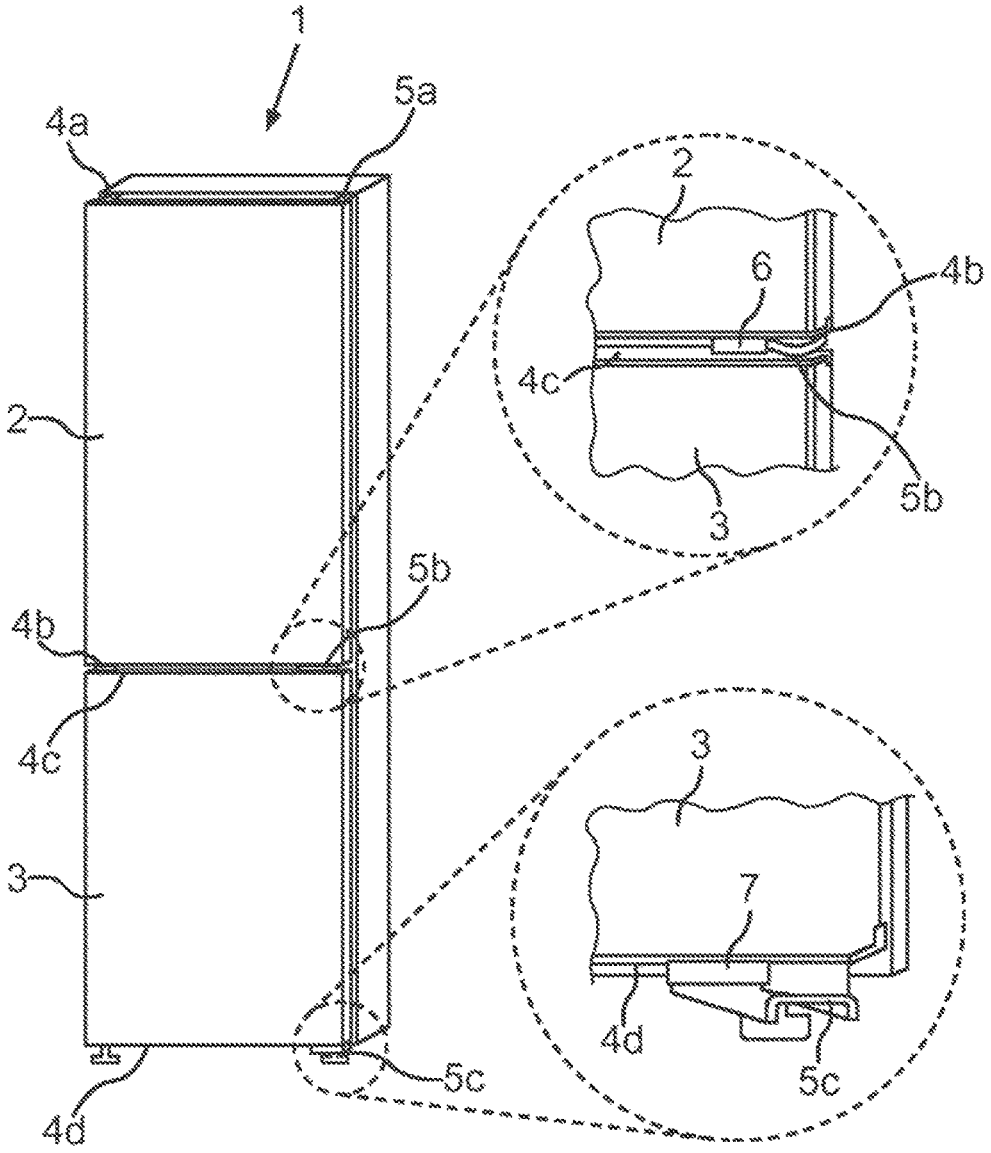
FIG. 1 shows a perspective front view of an exemplary embodiment of an inventive domestic refrigeration appliance with door closing fitting parts on an upper door and a lower door of the domestic refrigeration appliance shown enlarged.

FIG. 1 shows a domestic refrigeration appliance 1 which has an inner container, the walls of which delimit a storage chamber or receiving chamber for food. The domestic refrigeration appliance 1 has an upper door 2 and a second door 3 arranged below it in a vertical direction or in the heightwise direction of the domestic refrigeration appliance 1. The upper door 2 has an upper end wall 4*a* and a lower end wall 4*b* and the lower door 3 has an upper end wall 4*c*, these representing the narrow faces or the upper edge and lower edge of the doors in each instance. In the exemplary embodiment shown the two doors 2 and 3 are configured as doors that are hinged on the right, meaning that the doors 2 and 3 are opened manually with a pivot movement from left to right.

The domestic refrigeration appliance 1 also has door hinges 5*a*, 5*b* and 5*c*, which support the respective door leaf or the door 2, 3 in a pivotable manner. The door hinges 5*a*, 5*b* and 5*c* are configured to support the respective door 2, 3 in a first position, as shown in FIG. 1, hinged on the right and in a second embodiment (not shown) hinged on the left. As shown in both enlarged details in FIG. 1, a door closing fitting part 6, 7 is assigned to each lower door hinge 5*b*, 5*c* of each door 2, 3.

Figure 2:
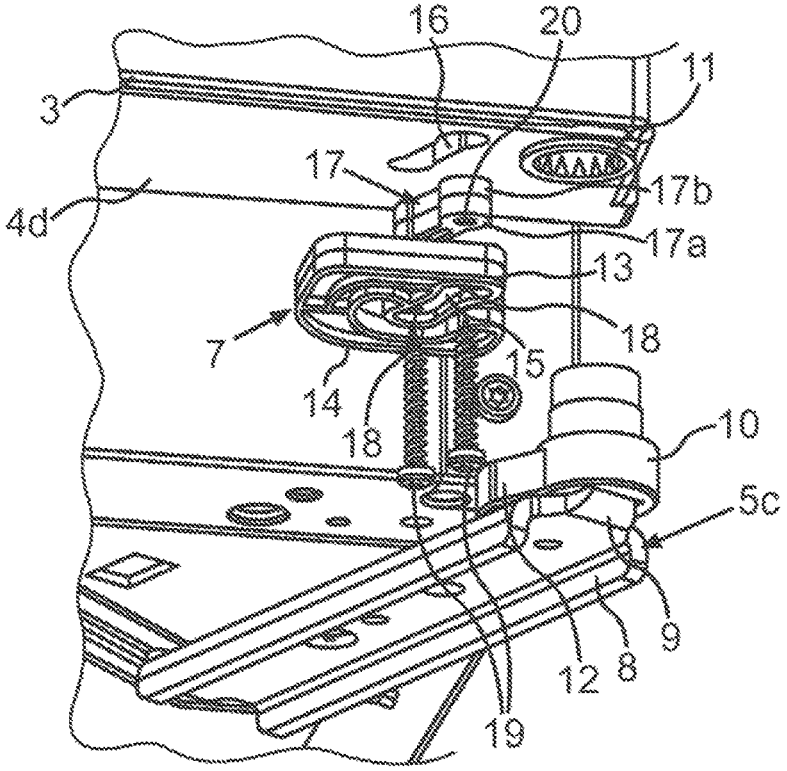
FIG. 2 shows a perspective exploded view of the door closing fitting part on the lower door of the domestic refrigeration appliance according to FIG. 1.
Figure 3:
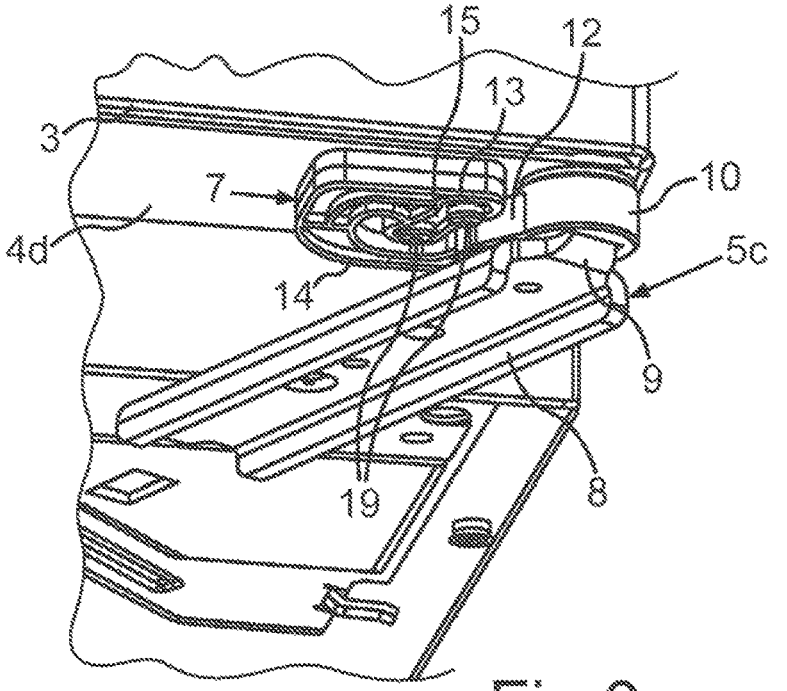
FIG. 3 shows a perspective exploded view of the door closing fitting part on the lower door of the domestic refrigeration appliance according to FIG. 1.

The lower door hinge 5*c* of the lower door 3 and the associated door closing fitting part 7 are shown in more detail in an exploded view in FIG. 2 and in the assembled state in FIG. 3.

The lower door hinge 5*c*, which is arranged at the base of the domestic refrigeration appliance 1, has a support 8. The support 8 is connected in a fixed manner to the domestic refrigeration appliance 1. It is therefore fastened to the housing here. The support 8 has an extension 9 that bends away at a right angle. A bearing bush 10 is positioned on, in particular attached to, the extension 9. The bearing bush 10 is formed by a plastic bush in the exemplary embodiment shown. In the mounted state, as shown in FIG. 3, the bearing bush 10 projects into a seat carrier 11 on the lower end wall 4*b* of the lower door 3, thereby forming a pivot joint of the door hinge 5*c*. The bearing bush 10 supports a cam-type activator contour in the form of a closing cam 12.

The door closing fitting part 7 of the lower door hinge 5*c*, which is configured in an identical manner to the door closing fitting part 6 of the door hinge 5*b*, has a fastening segment 13 and a spring segment 14. The fastening segment 13 is configured for the door closing fitting part 6, 7 to be mounted with both left and right hinges.

To this end the fastening segment 13 of the door closing fitting part 6, 7 has a depression 15 on each opposing side. The end wall 4*d* of the door 3 also has a cutout 16 configured with the correspondingly same shape, as shown in FIG. 2. The door closing fitting part 7 is fixed to the end wall 4*d* of the door leaf or the door 3 by means of a separate connecting piece 17. To this end the separate connecting piece 17 has a sub-segment 17*a*, which is inserted with a form fit optionally into one or the other depression 15 in the fastening segment 13 depending on the mounted position of the door closing fitting part 6, 7. A sub-segment 17*b* of the connecting piece 17 projecting from the depression 15 engages with a form fit in the cutout 16 in the end wall 4*d* of the door leaf in the mounted position.

The door closing fitting part 6, 7 is configured as an identical part for optional hinging on the right or left. The depressions 15 provided on the fastening segment 13 mean that the door closing fitting part 6, 7 can be particularly narrow. This means that the structural height of the door closing fitting part 6, 7 is very small. The illustrated door closing fitting part 6, 7 for example only has a structural height of 10 millimeters. This low structural height allows the door closing fitting part 6, 7 also to be mounted in a narrow gap for example between the upper door leaf or the upper door 2 and the lower door leaf or the lower door 3 of the domestic refrigeration appliance 1, as also shown for the door hinge 5*b* in FIG. 1.

It can also be seen in FIGS. 2 and 3 that the fastening segment 13 of the respectively illustrated door closing fitting part 6, 7 has just two through holes 18 arranged at a distance from one another in the illustrated exemplary embodiment. A screw 19 is inserted into each of the two through holes 18, fixing the door closing fitting part 6, 7 to the respective door 2, 3.

Figure 4:
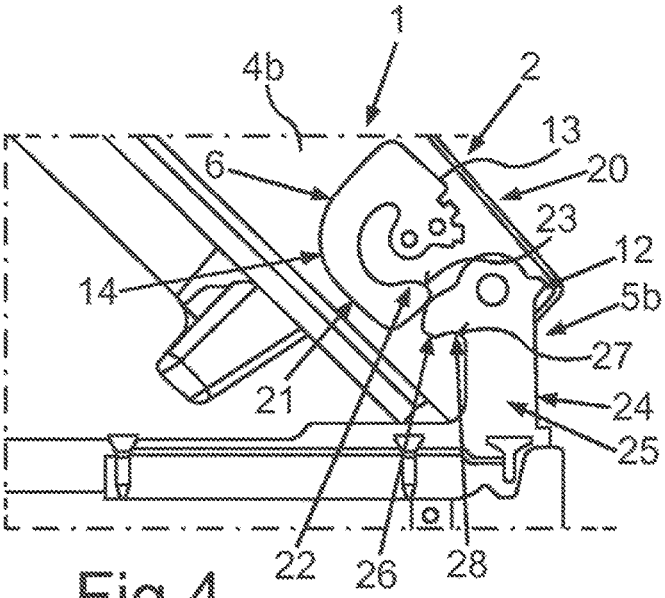
FIG. 4 shows a view from below of the domestic refrigeration appliance with the door open and a diagram of components of a closing system.
Figure 5:
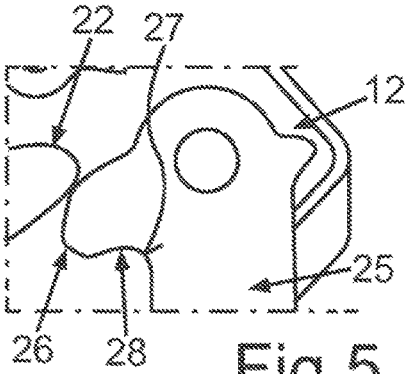
FIG. 5 shows an enlarged diagram of a partial detail in FIG. 4.
Figure 6:
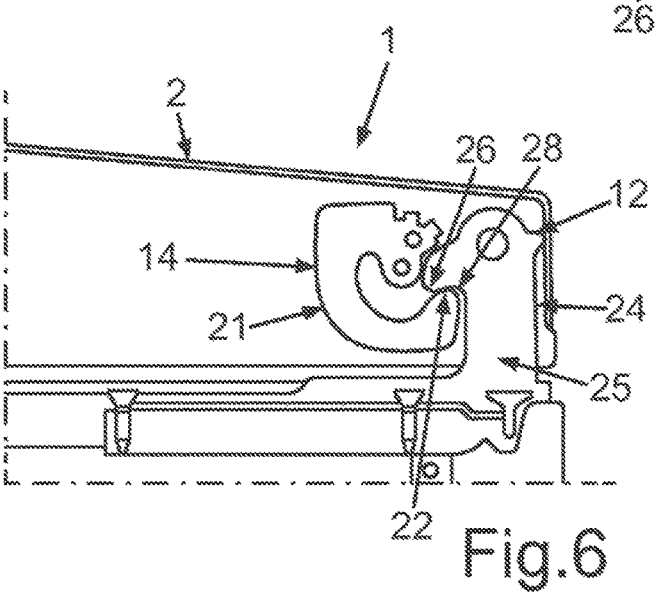
FIG. 6 shows a view from below of the domestic refrigeration appliance with the door closed completely in contrast to FIGS. 4 and 5.

Reference is made below to FIG. 4 to FIG. 6 to describe a closing system 20 of the domestic refrigeration appliance 1 further. To this end FIG. 4 shows a view from below of the domestic refrigeration appliance 1, looking at the narrow face or end wall 4*b* with the door 2 in the opened state. The abovementioned door closing fitting part 6 is fastened to the door 2 in a fixed position on this lower end wall 4*b*. This door closing fitting part 6 has the abovementioned fastening segment 13 and the spring segment 14, which is formed by a closing clip 21. A projection end piece 22 with a corner-free outer contour 23 is configured on a front free end of the closing clip 21.

A bearing element 24, having the abovementioned closing cam 12 and retaining web 25, is fastened to the housing 2 in a fixed position. The closing cam 12 has a coupling projection 26. The coupling projection 26 has a recess 28 on a coupling contour 27 that is facing when coupled to the closing clip 21. The projection end piece 22 engages in said recess 28 in the coupled state between the projection end piece 22 and the closing cam 12.

It can be seen that the coupling contour 27 of the recess 28 is also configured without corners. The coupling contour 27 has a concave curvature to form the recess 28. The recess 28 is also configured to hold the projection end piece 22 with a close fit at least in parts.

FIG. 5 shows an enlarged diagram of the closing cam 12 with the recess 28. The dip or depression in the coupling projection 26 formed by the recess 28 is clearly shown.

FIG. 6 shows a view from below like the one in FIG. 4 but FIG. 6 shows the door 2 in the completely closed state. It can also be seen here that the projection end piece 22 engages in said recess 28 and is therefore as it were latched therein to a certain degree or engages behind the coupling projection 26.

LIST OF REFERENCE CHARACTERS

1 Domestic refrigeration appliance
2 Door
3 Door
4*a* Upper end wall
4*b* Lower end wall
4*c* Lower end wall
4*d* End wall
5*a* Door hinge
5*b* Door hinge
5*c* Door hinge
6 Door closing fitting part
7 Door closing fitting part
8 Support
9 Extension
10 Bearing bush
11 Seat carrier
12 Closing cam
13 Fastening segment
14 Spring segment
15 Depression
16 Cutout
17 Connecting piece
17*a* Sub-segment
17*b* Sub-segment
18 Through holes
19 Screw
20 Closing system
21 Closing clip
22 Projection end piece
23 Outer contour
24 Bearing element
25 Retaining web
26 Coupling projection
27 Coupling contour
28 Recess

The invention claimed is:

1. A domestic refrigeration appliance, comprising:

a housing;

a door;

hinges pivotally mounting said door to said housing;

at least one of said hinges having a door closing fitting part with a closing clip disposed on an end wall of said door and a bearing element with a closing cam disposed on said housing, said closing cam being coupled to said closing clip when said door is closed;

said closing clip having opposing mounting surfaces, said closing clip being mounted to said end wall on one of said opposing surfaces, said opposing mounting surfaces being parallel to said end wall in an installed position of said closing clip on said end wall, said closing clip being formed with a projection end piece defining a projection outer contour having an external radius, said projection outer contour being a surface of said closing clip connecting said opposing mounting surfaces to one another;

said closing cam having a coupling projection and a recess formed in a coupling contour facing towards said closing clip in a coupled state, said coupling projection having a rounded contour, said recess being defined by an internal radius;

a pivot axis of said hinges, said coupling projection of said closing cam extending generally away from said pivot axis, said projection end piece of said closing clip extending generally toward said pivot axis when said door is closed; and said coupling contour having a surface which is generally perpendicular to said direction of extension of said projection end piece, said projection end piece of said closing clip engaging in said recess with said external radius contacting said internal radius, in the coupled state when said door is closed, where said surface of said coupling contour is configured to hold said projection end piece in direct contact at least in parts.

2. The domestic refrigeration appliance according to claim 1, wherein said coupling contour of said recess is configured without corners.

3. The domestic refrigeration appliance according to claim 1, wherein said projection end piece has a corner-free contour on a side thereof facing towards said recess.

4. The domestic refrigeration appliance according to claim 1, wherein said coupling contour has a concave curvature to form said recess.

5. The domestic refrigeration appliance according to claim 1, wherein said closing clip is arranged in a resilient manner on said door closing fitting part.

6. The domestic refrigeration appliance according to claim 1, wherein said door closing fitting part is arranged on a lower end face wall of said door.

* * * * *